US009085174B2

(12) United States Patent
Sasaki et al.

(10) Patent No.: US 9,085,174 B2
(45) Date of Patent: Jul. 21, 2015

(54) RECORDING APPARATUS

(71) Applicant: SEIKO EPSON CORPORATION, Tokyo (JP)

(72) Inventors: Tsuneyuki Sasaki, Matsumoto (JP); Eiji Kumai, Matsumoto (JP); Yasuo Naramatsu, Matsumoto (JP); Masahiro Akamine, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/198,098

(22) Filed: Mar. 5, 2014

(65) Prior Publication Data

US 2014/0285601 A1 Sep. 25, 2014

(30) Foreign Application Priority Data

Mar. 19, 2013 (JP) ..... 2013-056184

(51) Int. Cl.
*B41J 2/01* (2006.01)
*B41J 11/00* (2006.01)
*B41J 11/06* (2006.01)

(52) U.S. Cl.
CPC ..... *B41J 11/002* (2013.01); *B41J 11/06* (2013.01)

(58) Field of Classification Search
CPC ... B41J 11/002; B41J 11/0015; B41M 7/0072
USPC ..... 347/102
See application file for complete search history.

(56) References Cited

U.S. PATENT DOCUMENTS

| | | | | |
|---|---|---|---|---|
| 6,244,700 | B1 * | 6/2001 | Kimura et al. | 347/102 |
| 6,439,712 | B1 | 8/2002 | Mizutani et al. | |
| 8,197,024 | B2 * | 6/2012 | Kovacs et al. | 347/18 |
| 8,272,729 | B2 * | 9/2012 | Caiger et al. | 347/102 |
| 8,929,787 | B2 * | 1/2015 | Ishimori | 399/323 |
| 2009/0295894 | A1 | 12/2009 | Hori | |
| 2012/0075394 | A1 | 3/2012 | Ohnishi | |

FOREIGN PATENT DOCUMENTS

| | | | | |
|---|---|---|---|---|
| JP | 01-288450 | | 11/1989 | |
| JP | 03-147850 | | 6/1991 | |
| JP | 08-224871 | | 9/1996 | |
| JP | 2000-075773 | | 3/2000 | |
| JP | 2000075773 | A * | 3/2000 | G03G 21/20 |
| JP | 2005-014560 | | 1/2005 | |

(Continued)

OTHER PUBLICATIONS

European Search Report for Application No. 14160497.5 dated Jul. 28, 2014.

*Primary Examiner* — Alessandro Amari
*Assistant Examiner* — Jeremy Bishop
(74) *Attorney, Agent, or Firm* — Workman Nydegger

(57) ABSTRACT

A recording apparatus that includes a condensation guide portion is provided. The recording apparatus includes a recording head that discharges ink onto a recording medium, a heater that dries the ink discharged on the recording medium by the recording head without making contact with the recording medium, a medium supporting portion provided with an opening portion which allows vapor that evaporates from the ink due to the heater to pass therethrough, and a condensation guide portion which causes the vapor that passes through the opening portion to condense and thereby prevent the recording medium from being wetted by the condensed vapor.

9 Claims, 3 Drawing Sheets

(56) References Cited

FOREIGN PATENT DOCUMENTS

| | | |
|---|---|---|
| JP | 2005-199434 | 7/2005 |
| JP | 2006-095774 | 4/2006 |
| JP | 2008-030359 | 2/2008 |
| JP | 2008-137158 | 6/2008 |
| JP | 2009-285877 | 12/2009 |
| JP | 2010-280828 | 12/2010 |
| JP | 2012-116063 | 6/2012 |
| JP | 2012-232424 | 11/2012 |
| WO | 2012/041725 | 4/2012 |

* cited by examiner

RECORDING APPARATUS

This application claims the benefit of Japanese Application No. 2013-056184 filed on Mar. 19, 2013. The foregoing application is incorporated by reference in its entirety.

BACKGROUND

1. Technical Field

Embodiments of the present invention relate to a recording apparatus provided with a heater that dries ink that is recorded on a recording medium.

2. Related Art

Recording apparatuses provided with a heater that dry ink that is recorded on a recording medium are used in the related art. Ink jet recording apparatuses record by discharging ink onto a recording medium. When the recording apparatus is provided with a heater, the heater dries a portion of the recording medium on which the ink is recorded without making contact therewith in order to dry the ink recorded on the recording medium. For example, JP-A-2010-280828 discloses a recording apparatus that is capable of drying the ink on a recording medium by heating the recording medium using a heater from the side of a platen, which is a medium supporting portion.

In addition, a transfer system recording apparatus is used, for example, in systems that do not discharge ink onto a recording medium. For example, JP-A-2000-75773 discloses an apparatus that includes a dehumidifying unit. The dehumidifying unit condenses water vapor generated when a toner image that is transferred on a transfer material makes contact with a heating roller, which is equivalent to a heater.

However, in a recording apparatus with a heater that dries a portion on which the ink is recorded without making contact, such as the one disclosed in JP-A-2010-280828, there is a case in which the vapor that evaporates from the ink due to the heater condenses on the medium supporting portion and the recording medium is wetted. In particular, in a recording apparatus provided with a heater that dries the ink recorded on the recording medium from a side which opposes the medium supporting portion, there are many cases in which the recording medium is wetted due to the vapor condensing on the medium supporting portion. Furthermore, in regard to the ink jet recording apparatus that records by discharging an ink onto a recording medium, the technology of JP-A-2000-75773 cannot be adopted. This is because, when using a heater that which makes contact with and dries the portion on which the ink is recorded, the image quality of the recorded portion decreases due to the contact between the recorded portion and the heater.

SUMMARY

Therefore, an advantage of some aspects of embodiments the invention is to suppress the condensation of vapor on a medium supporting portion in a recording apparatus provided with a heater that dries the ink without making contact with the recording medium. The ink is recorded on the recording medium by discharging the ink onto the recording medium and embodiments of the invention suppress the condensation of vapor that evaporates from the ink due to the heater.

According to an aspect of an embodiment of the invention, a recording apparatus includes a recording head that is configured to discharge ink onto a recording medium, a heater that is configured to dry the ink discharged on the recording medium by the recording head without making contact with the recording medium, and a medium supporting portion that provided with an opening portion. The opening portion allows vapor that evaporates from the ink due to the heater to pass therethrough. The recording apparatus may also include a condensation guide portion. The condensation guide portion causes the vapor that passes through the opening portion to condense.

According to this aspect, the medium supporting portion is provided with an opening portion that is configured to allow vapor that evaporates from the ink to pass therethrough. In addition, the recording apparatus is provided with a condensation guide portion that is configured to cause the vapor that passes through the opening portion to condense. Therefore, it is possible to guide the vapor to the condensation guide portion and cause the vapor to condense on the condensation guide portion before the vapor, which evaporates from the ink, condenses on the medium supporting portion. In other words, it is possible to suppress the condensation of vapor, which evaporates from the ink due to the heater, on the medium supporting portion in a recording apparatus provided with a heater which dries the ink that has been recorded on the recording medium without making contact with a portion on which the ink is recorded.

The thermal diffusivity of the condensation guide portion may be greater than the thermal diffusivity of the medium supporting portion.

According to this aspect, the thermal diffusivity of the condensation guide portion is greater than the thermal diffusivity of the medium supporting portion. Therefore, the condensation guide portion can cause the vapor to condense more easily than the medium supporting portion. It is possible to cause the vapor to condense on the condensation guide portion with high precision before the vapor, which evaporates from the ink, condenses on the medium supporting portion, and it is possible to suppress the vapor from condensing on the medium supporting portion.

The thermal conductivity of the condensation guide portion may be greater than the thermal conductivity of the medium supporting portion.

According to this aspect, the thermal conductivity of the condensation guide portion is greater than the thermal conductivity of the medium supporting portion. Therefore, setting the thermal diffusivity of the condensation guide portion to be higher than the thermal diffusivity of the medium supporting portion is facilitated, and the manufacture of the intended condensation guide structure is facilitated.

A contact angle between the medium supporting portion and droplets formed by condensation of the vapor may be greater than the contact angle between the condensation guide portion and the droplets.

According to this aspect, the contact angle between the medium supporting portion and droplets formed by condensation of the vapor is greater than the contact angle between the condensation guide portion and the droplets. A larger contact angle indicates that the droplets are more easily repelled and that the droplets do not condense easily. In other words, the condensation guide portion can cause the vapor to condense more easily than the medium supporting portion. In addition, it is possible to cause the vapor to condense on the condensation guide portion with high precision before the vapor condenses on the medium supporting portion, and it is possible to suppress the condensation of the vapor on the medium supporting portion. Furthermore, for example, even if the vapor condenses on the medium supporting portion and droplets are formed thereon, since the contact angle of the medium supporting portion is greater that the contact angle of the condensation guide portion, it is possible to guide the droplets to the condensation guide portion.

The condensation guide portion may be disposed such that an interval between the medium supporting portion and the condensation guide portion may be in a range from 2 mm to 20 mm or more than 2 mm or less than 20 mm.

Due to the interval between the condensation guide portion and the medium supporting portion being 2 mm or more, it is possible to suppress the adhesion of the droplets that condense on the condensation guide portion on the medium supporting portion. In addition, due to the interval between the condensation guide portion and the medium supporting portion being 20 mm or less, it is possible to suppress the condensation of the vapor on the medium supporting portion with high precision.

At least a portion of the medium supporting portion may be configured by or with a linear member or by or with a plurality of linear members with a diameter of 0.3 mm or less.

Because at least a portion of the medium supporting portion is configured by a linear member with a diameter of 0.3 mm or less, the vapor does not easily condense on a contact portion between the medium supporting portion and the recording medium, and it is possible to suppress the vapor from condensing on the medium supporting portion with high precision.

An aperture ratio of the opening portion in relation to the medium supporting portion may be 40% or more.

Because the aperture ratio of the opening portion in relation to the medium supporting portion is 40% or more, which is high, it is easy to allow the vapor to pass through the condensation guide portion, and it is possible to suppress the vapor from condensing on the medium supporting portion with high precision.

A plurality of the condensation guide portions may be provided.

According to this aspect, it is possible to dispose or arrange the condensation guide portion in various configurations. For example, it is possible to suppress the condensation of the vapor on the medium supporting portion with high precision by providing a plurality of the condensation guide portions. In one example each condensation guide portion may have a different thermal diffusivity. The condensation guide portions may be configured such that the further from the medium supporting portion the condensation guide portion is provided, the higher the thermal diffusivity.

At least a portion of the medium supporting portion may include stainless steel. Because at least a portion of the medium supporting portion includes or is configured with stainless steel, it is possible to configure the medium supporting portion such that the vapor does not easily condense.

At least a portion of the condensation guide portion may be configured by aluminum. Because at least a portion of the condensation guide portion is configured by or includes aluminum, it is easy to cause the vapor to condense, and it is possible to suppress the condensation of the vapor on the medium supporting portion with high precision.

BRIEF DESCRIPTION OF THE DRAWINGS

Embodiments of invention will be described with reference to the accompanying drawings, wherein like numbers reference like elements.

DESCRIPTION OF EXEMPLARY EMBODIMENTS

A detailed description will be given below of recording apparatuses according to the embodiments of the invention with reference to the attached drawings.

Embodiments of the recording apparatus can perform recording onto a recording medium using an aqueous ink. However, embodiments of the invention are not limited to a recording apparatus that can use an aqueous ink.

Figure 1:
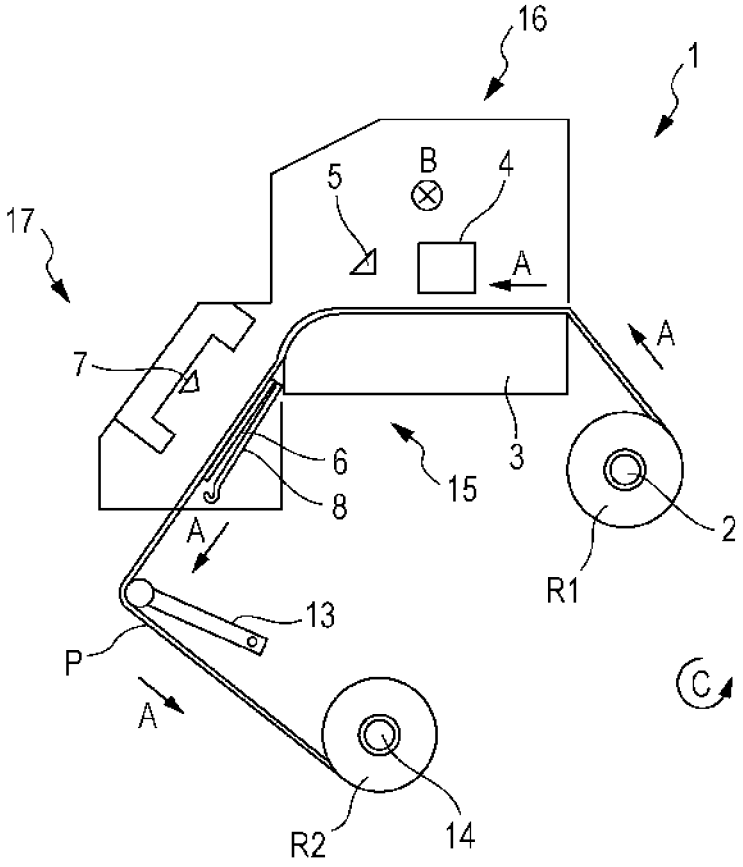
FIG. 1 is a schematic side view which shows an example of a recording apparatus.

FIG. 1 shows a schematic side view of an embodiment of a recording apparatus 1.

The recording apparatus 1 is provided with a setting portion 2 of a recording medium P. The setting portion 2 can feed a roll R1 of the recording medium P through the recording apparatus 1 and perform a recording operation on the medium P. Furthermore, the recording apparatus 1 may use a roll-type recording medium as the recording medium P. However, embodiments are not limited to a recording apparatus that uses such a roll-type recording medium. For example, a cut-sheet type of recording medium may also be used.

In the recording apparatus 1, when the recording medium P is transported in a transport direction A, the setting portion 2 rotates in a rotation direction C.

In addition, the recording apparatus 1 includes a transport mechanism 15. The transport mechanism 15 includes a plurality of transport rollers. The transport rollers are configured for transporting the roll-type recording medium P or other medium in the transport direction A.

In addition, the recording apparatus 1 includes a recording mechanism 16. The recording mechanism 16 performs a recording operation or records on the medium P by causing a recording head 4 to scan the recording medium P reciprocally in a scanning direction B that intersects the transport direction A of the recording medium P. The recording head 4 discharges an ink onto the recording medium P. An image is formed (recorded) on the recording medium P by the ink that is discharged from the recording head 4. Furthermore, the recording apparatus 1 includes the recording mechanism 16, which performs recording by causing the recording head 4 to scan the recording medium P reciprocally. However, the recording apparatus 1 may alternatively include a so-called line head. In a line head, a plurality of nozzles that discharge an ink are provided in a direction intersecting the transport direction A.

The recording apparatus 1 includes a drying mechanism 17. The drying mechanism 17 is provided on the downstream side in the transport direction A of the recording medium P of the recording head 4. The drying mechanism 17 dries the recording medium P that is transported to the medium supporting portion 6 using a heater 7. The heater 7 is configured with an infrared heater. The heater 7 is provided in a position opposing the medium supporting portion 6. The heater 7 is configured to dry a portion on which ink is recorded, in one example, without making contact with the recording medium.

The drying mechanism 17 includes a condensation guide portion 8 on the lower portion of the medium supporting portion 6. Furthermore, as long as the heater 7 is a heater that dries a portion on which ink is recorded without making contact with the portion of the recording medium, the type, shape, installation location and the like thereof are not particularly limited. In other words, the heater 7 may be a heater that dries the ink without making contact with the recording medium. However, while condensation occurs easily on the medium supporting portion in a recording apparatus that is configured with a heater that is provided in a position opposing the medium supporting portion, the condensation suppression effect of embodiments of the invention is particularly great in a recording apparatus with such a configuration.

In addition, the recording apparatus 1 may include a tension adjustment unit 13. The tension adjustment unit 13 is provided on the downstream side in the transport direction A of the recording medium P of the drying mechanism 17. The tension adjustment unit 13 serves to adjust the tension of the recording medium P when winding the recording medium P. Furthermore, a winding unit 14 that is configured to wind the recording medium P is provided on the downstream side in the transport direction A of the recording medium P of the tension adjustment unit 13. Furthermore, in the recording apparatus 1, when the recording medium P is wound, the winding unit 14 rotates in a rotation direction C.

Next, a detailed description will be given of the medium supporting portion 6 and of the condensation guide portion 8.

Figure 2:
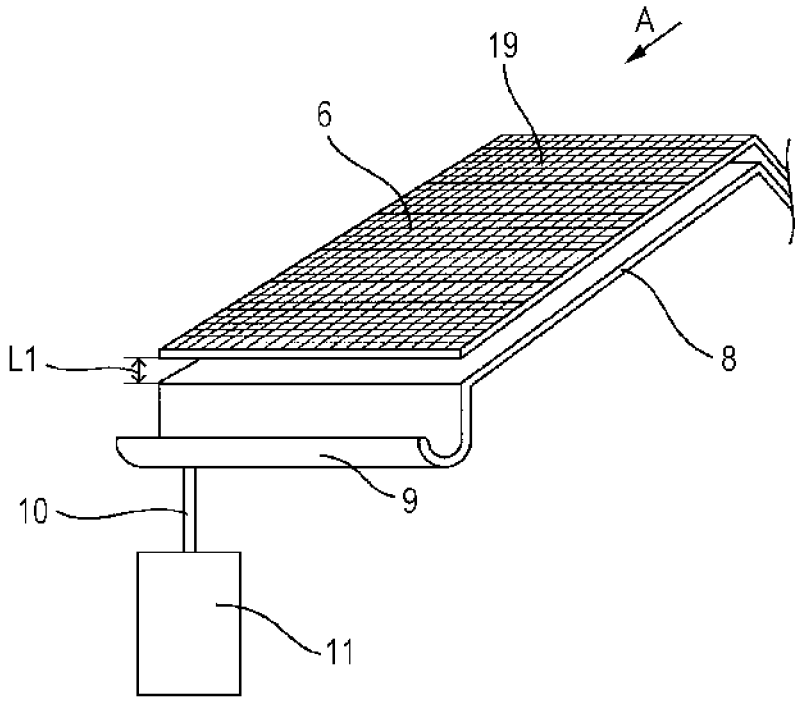
FIG. 2 is a schematic perspective view which shows an example of a medium supporting portion and an example of a condensation guide portion in the recording apparatus.

FIG. 2 is a schematic perspective view which shows an example of the medium supporting portion 6 and an example of the condensation guide portion 8 in the recording apparatus 1.

The medium supporting portion 6 of this example is provided with an opening portion 19. The opening portion 19 allows vapor that evaporates from the ink due to the heater 7 to pass therethrough. Furthermore, as long as the opening portion 19 is provided, the shape and the like thereof is not particularly limited.

However, at least a portion of the opening portion 19 is configured by a linear member with a diameter of 0.3 mm or less in one example. This is because it is possible to suppress the condensation of the vapor on the contact portion of the recording medium P in relation to the medium supporting portion 6 with high precision.

Table 1 below shows the experimental results of a case in which the diameter of the linear member is changed and whether or not the vapor, which evaporates from the ink recorded on the recording medium P, condenses on the medium supporting portion 6 is evaluated. Using visual observation, a case in which condensation does not form on the medium supporting portion 6 is shown as OK, and a case in which condensation does form on the medium supporting portion 6 is shown as NG.

TABLE 1

| Diameter of Linear Member (mm) | Evaluation Result |
|---|---|
| 0.1 | OK |
| 0.2 | OK |
| 0.3 | OK |
| 0.4 | NG |
| 0.5 | NG |
| 0.6 | NG |
| 0.7 | NG |
| 0.8 | NG |
| 0.9 | NG |
| 1.0 | NG |

In addition, the aperture ratio of the opening portion 19 in relation to the medium supporting portion 6 is 40% or more in one example. It is possible to suppress the condensation of the vapor on the medium supporting portion 6 with high precision when the ratio is 40% or more.

Table 2 below shows the experimental results of a case in which the aperture ratio of the opening portion 19 in relation to the medium supporting portion 6 is changed and whether or not the vapor, which evaporates from the ink recorded on the recording medium P, condenses on the medium supporting portion 6 is evaluated. Using visual observation, a case in which condensation does not form on the medium supporting portion 6 is shown as OK, and a case in which condensation does form on the medium supporting portion 6 is shown as NG.

TABLE 2

| Aperture Ratio (%) | Evaluation Result |
|---|---|
| 10 | NG |
| 20 | NG |
| 30 | NG |
| 40 | OK |
| 50 | OK |
| 60 | OK |
| 70 | OK |
| 80 | OK |
| 90 | OK |
| 100 | OK |

Furthermore, at least a portion of the medium supporting portion 6 is made from or includes stainless steel. In addition to being inexpensive and strong, stainless steel has a low thermal diffusivity and a low thermal conductivity. Further, the contact angle between the stainless steel and the droplets formed by the condensation of the vapor is great and stainless steel is not easily wetted. Be making at least a portion of the medium supporting portion 6 of stainless steel, it is possible to suppress the condensation of the vapor on the medium supporting portion 6 with high precision.

In addition, for the medium supporting portion 6, it is also possible to use a member that includes or is made from a metal other than stainless steel (steel or iron, for example) subjected to nickel plating or chrome plating. This member also has a low thermal diffusivity and a low thermal conductivity. Because the contact angle between the member and the droplets formed by the condensation of the vapor is great and the member is not easily wetted, it is possible to suppress the condensation of the vapor on the medium supporting portion 6 with high precision.

Furthermore, the term "thermal diffusivity" is also known as "heat diffusivity", "thermometric conductivity" and the like, and is obtained by dividing the thermal conductivity by the product of the density and the specific heat capacity in one example.

The condensation guide portion 8 of this example is a component for causing the vapor that passes through the opening portion 19 to condense. In addition, a liquid receptacle 9, which receives the droplets formed by the condensation of the vapor, is provided on the lower portion of the condensation guide portion 8. In addition, a waste liquid bottle 11 for collecting the liquid collected in the liquid receptacle 9 via a tube 10 is provided on the lower portion of the liquid receptacle 9. The condensation guide portion 8 may be sloped relative to the medium supporting portion 6.

The shape and the like of the condensation guide portion 8 of this example is not particularly limited. However, the thermal diffusivity of the condensation guide portion 8 may be higher than the thermal diffusivity of the medium supporting portion 6 in example. It is possible to suppress the condensation of the vapor on the medium supporting portion 6 with high precision due in part to the difference in thermal diffusivity. In addition, the thermal conductivity of the condensation guide portion 8 may be higher than the thermal conductivity of the medium supporting portion 6.

In addition, the contact angle between the condensation guide portion 8 and the droplets that form by the condensation of the vapor may be smaller than the contact angle between the medium supporting portion 6 and the droplets. As a result of the differences in the contact angle, it is possible to suppress the condensation of the vapor on the medium supporting portion 6 with high precision.

In addition, the condensation guide portion 8 may be disposed such that an interval L1 between the medium supporting portion 6 and the condensation guide portion 8 is in a range from 2 mm to 20 mm. In one example, the interval L1 between the condensation guide portion 8 and the medium supporting portion 6 is not fixed. In other words, the interval L1 may vary in the transport direction and/or in the direction transverse to the transport direction. However, the medium supporting portion 6 may be disposed such that the interval L1 is in the range from 2 mm to 20 mm at any portion thereof. Because the interval between the condensation guide portion 8 and the medium supporting portion 6 may be 2 mm or more, it is possible to suppress the adhesion of the droplets that condense on the condensation guide portion 8 on the medium supporting portion 6. In one example, the interval L1 prevents the droplets that condense on the condensation portion 8 from contacting or adhering to the medium supporting portion 6 due to the interval L1. In addition, due to the interval between the condensation guide portion 8 and the medium supporting portion 6 being 20 mm or less, it is possible to suppress the condensation of the vapor on the medium supporting portion 6 with high precision. The interval L1 may be set such that the vapor condenses on the condensation guide portion 8 and not on the medium supporting portion 6.

Table 3 below shows the experimental results of a case in which the interval between the condensation guide portion 8 and the medium supporting portion 6 is changed and whether or not the vapor, which evaporates from the ink recorded on the recording medium P, condenses on the medium supporting portion 6 is evaluated. Using visual observation, a case in which condensation does not form on the medium supporting portion 6 is shown as OK, and a case in which condensation does form on the medium supporting portion 6 is shown as NG. Furthermore, when the interval between the condensation guide portion 8 and the medium supporting portion 6 is less than 2 mm, the droplets that condense on the condensation guide portion 8 may adhere to the medium supporting portion 6.

TABLE 3

| Interval (mm) | Evaluation Results |
|---|---|
| 2 | OK |
| 4 | OK |
| 6 | OK |
| 8 | OK |
| 10 | OK |
| 12 | OK |
| 14 | OK |
| 16 | OK |
| 18 | OK |
| 20 | OK |
| 22 | NG |
| 24 | NG |
| 26 | NG |
| 28 | NG |
| 30 | NG |

Furthermore, at least a portion of the condensation guide portion 8 may be made from aluminum. In addition to being able to achieve a tough configuration due to being inexpensive and light, aluminum has a high thermal diffusivity and a high thermal conductivity. In addition, the contact angle between the aluminum and the droplets formed by the condensation of the vapor is small and aluminum is easily wetted. Therefore it is possible to guide or direct (e.g., via the opening portion 19) the vapor to the condensation guide portion 8 and cause the vapor to condense on the condensation guide portion 8 before the vapor condenses on the medium supporting portion 6, and it is possible to suppress the condensation of the vapor on the medium supporting portion 6 with high precision.

Figure 3:
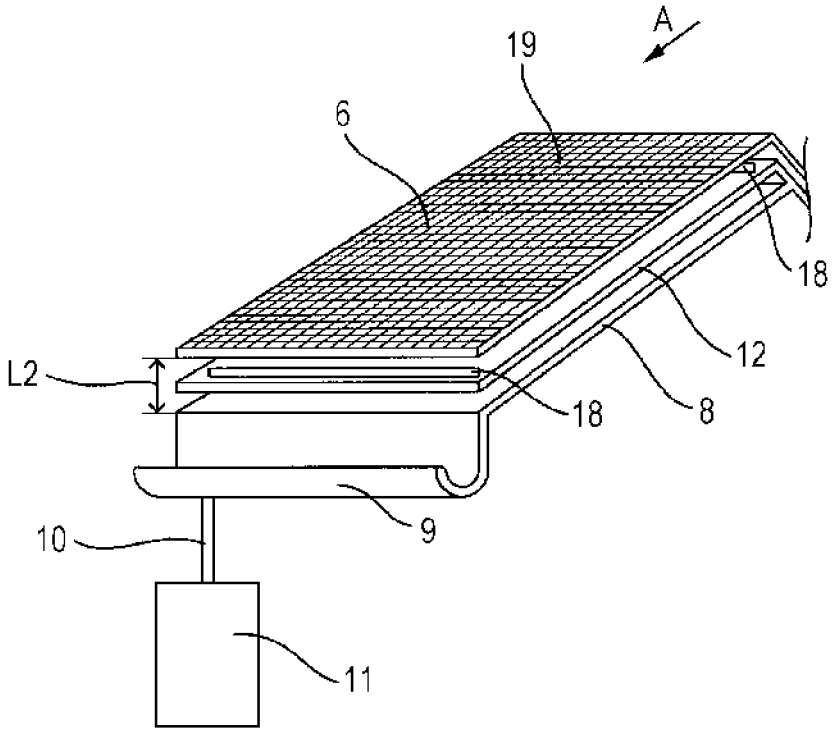
FIG. 3 is a schematic perspective view which shows an example of a medium supporting portion and an example of a condensation guide portion in a recording apparatus.

FIG. 3 is a schematic perspective view that shows an example of the medium supporting portion 6, the condensation guide portion 8 and a condensation guide portion 12 in the recording apparatus 1. Furthermore, components which are common with those previously described above are represented with the same reference numerals, and detailed description thereof is omitted.

In this example of the recording apparatus 1, a plurality of condensation guide portions 8 and 12 are provided. Furthermore, the recording apparatus 1 may also be provided with three or more condensation guide portions.

The recording apparatus 1 may be provided with or include the condensation guide portion 12. The condensation guide 12 is disposed between the medium supporting portion 6 and the condensation guide portion 8, as illustrated in FIG. 3. The condensation guide portion 12 is configured to be joined with the condensation guide portion 8 at one end side thereof in the transport direction A. The condensation guide portion 12 may be provided with through holes 18. The through holes 18 can allow the vapor to pass through to the condensation guide portion 8, near both ends thereof in the transport direction A. The condensation guide portion may only connect to one end of the condensation guide portion 8 and may have multiple through holes disposed in various locations.

Furthermore, the condensation guide portion 8 is disposed such that an interval L2 between the medium supporting portion 6 and the condensation guide portion 8 is in a range from 2 mm to 20 mm across the entirety of the interval L2. Both the condensation guide portion 12 and the condensation guide portion 8 may be sloped relative to the medium supporting portion 6 and still be disposed such that the interval L2 is in a range of 2 mm to 20 mm. Further, one or both of the condensation guide portions 8 and 12 may be planer or have a slight curve (convex or concave) in either the transport direction or the direction transverse to the transport direction.

In one example, the condensation guide portion 8 is a first condensation guide portion, and the condensation guide portion 12 is a second condensation guide portion.

The recording apparatus 1 may be provided with a plurality of the condensation guide portions 8 and 12. The effect of the condensation guide portion that has a plurality of condensation guide portions is greater than that of the recording apparatus 1 with a single condensation guide portion. Furthermore, the configuration of FIG. 3 is capable of suppressing the condensation of the vapor on the medium supporting portion 6 with high precision.

Furthermore, the examples of the recording apparatuses 1 are capable of recording using an aqueous ink, which contains an aqueous organic solvent. In regard to a recording apparatus that uses such an ink, an aqueous organic solvent is contained in the vapor. The aqueous organic solvent does not easily volatilize when the vapor condenses on the medium supporting portion 6. As a result, the recording medium may be wetted due to the aqueous organic solvent. Therefore, while embodiments of the invention are particularly valid in a recording apparatus, which can perform recording using an aqueous ink that contains an aqueous organic solvent, the invention is not limited to such a recording apparatus.

In addition, in a transport mechanism 15 that functions as the transport unit, a platen heater 5, which is capable of heating the recording medium P at the platen 3, may also be provided.

Furthermore, the platen heater 5 of this example may be an infrared heater provided in a position opposing the platen 3. However, the platen heater 5 is not limited to such a heater, and a heater may also be used which is capable of heating the recording medium P from the platen 3 side.

Furthermore, when the only heater in the recording apparatus is the heater 7, the term "heater" refers to the heater 7. In addition, when the platen heater 5 is provided in addition to the heater 7, the platen heater 5 and the heater 7 are distinguished as a first heater and a second heater, respectively.

What is claimed is:

1. A recording apparatus, comprising:

a recording head configured to discharge ink onto a recording medium;

a heater configured to dry the ink discharged on the recording medium by the recording head without making contact with the recording medium;

a medium supporting portion that includes an opening portion, wherein the opening portion allows vapor that evaporates from the ink due to the heater to pass therethrough; and a condensation guide portion that causes the vapor that passes through the opening portion to condense, wherein a thermal diffusivity of the condensation guide portion is greater than a thermal diffusivity of the medium supporting portion, wherein the medium supporting portion is made of a metal.

2. The recording apparatus according to claim 1, wherein a thermal conductivity of the condensation guide portion is greater than a thermal conductivity of the medium supporting portion.

3. The recording apparatus according to claim 1, wherein, a contact angle between the medium supporting portion and droplets formed by condensation of the vapor is greater than a contact angle between the condensation guide portion and the droplets.

4. The recording apparatus according to claim 1, wherein the condensation guide portion is disposed such that an interval between the medium supporting portion and the condensation guide portion is in a range from 2 mm to 20 mm.

5. The recording apparatus according to claim 1, wherein at least a portion of the medium supporting portion is configured by a linear member with a diameter of 0.3 mm or less.

6. The recording apparatus according to claim 1, wherein an aperture ratio of the opening portion in relation to the medium supporting portion is 40%-90%.

7. The recording apparatus according to claim 1, further comprising a plurality of the condensation guide portions.

8. The recording apparatus according to claim 1, wherein at least a portion of the medium supporting portion is configured of stainless steel.

9. The recording apparatus according to claim 1, wherein at least a portion of the condensation guide portion is configured of aluminum.

* * * * *